United States Patent [19]

Townend

[11] Patent Number: 4,971,129

[45] Date of Patent: Nov. 20, 1990

[54] AIRCRAFT HANGAR DOOR ARRANGEMENT

[76] Inventor: David C. Townend, 212A Mile Cross Lane, Norwich NR6 6SE, Norfolk, England

[21] Appl. No.: 465,420

[22] Filed: Jan. 16, 1990

Related U.S. Application Data

[63] Continuation-in-part of Ser. No. 328,022, Mar. 23, 1989, abandoned, which is a continuation-in-part of Ser. No. 185,773, Apr. 25, 1988, abandoned.

[30] Foreign Application Priority Data

May 9, 1987 [GB] United Kingdom ..... 8711024

[51] Int. Cl.[5] ..... E05D 15/26

[52] U.S. Cl. ..... 160/213; 160/193; 52/69; 52/71

[58] Field of Search ..... 160/213, 207, 188, 189, 160/113, 115, 117, 114, 116, 118, 119; 52/68, 69, 71, 64

[56] References Cited

U.S. PATENT DOCUMENTS

| | | | |
|---|---|---|---|
| 2,238,181 | 4/1941 | Morgan | 160/213 X |
| 2,936,830 | 5/1960 | Mosher | 160/188 |
| 3,074,518 | 1/1963 | Conrad et al. | 160/213 X |
| 3,207,208 | 9/1965 | Houk et al. | 160/189 |
| 3,238,995 | 3/1966 | Bonzer | 160/117 |
| 3,871,436 | 3/1975 | Gile | 160/188 |
| 4,124,055 | 11/1978 | Aspenson et al. | 160/213 X |
| 4,261,409 | 4/1981 | De Vore | 160/207 |
| 4,545,418 | 10/1985 | List et al. | 160/313 |
| 4,609,027 | 9/1986 | Keller | 160/213 X |
| 4,637,446 | 1/1987 | McQueen et al. | 160/213 X |

*Primary Examiner*—David M. Purol

*Attorney, Agent, or Firm*—Edwin D. Schindler

[57] ABSTRACT

A hanger door arrangement which comprises a door having two upper door panels adapted to be pivotally connected to the top of the hanger door opening in side-by-side relationship and two lower door panels pivotally connected to the lower edges of the upper panels, and an operating mechanism which raises the door to an open position in which the lower panels allow passage of the wings of an aircraft beneath them and the tailgate between them.

8 Claims, 4 Drawing Sheets

AIRCRAFT HANGAR DOOR ARRANGEMENT

RELATED APPLICATIONS

This application is a continuation in part of my copending U.S. patent application Ser. No. 328,022, filed 23rd Mar. 1989, now abandoned itself a continuation in part of my U.S. patent application Ser. No. 185,773, filed 25th Apr. 1988 and now abandoned.

FIELD OF THE INVENTION

This invention relates to an aircraft hangar door arrangement.

PRIOR ART

From U.K. Patent Specification No. 2169345, for example, is known a hangar door disposed in a generally vertical plane when closed and having an upper leaf and a lower leaf pivotally suspended therefrom, and an operating mechanism for said door which in use acts to raise and turn the upper leaf into an approximately horizontal plane and fold the lower leaf back beneath said upper leaf when the door is opened.

It is an object of this invention to provide an improved arrangement of a hangar door.

BRIEF SUMMARY OF THE INVENTION

According to the invention there is provided, in combination with an aircraft hangar building for housing an aircraft which includes wings and a central tailgate, said hangar building having a front opening which has an upper boundary of inverted V-shape defining an apex of the opening, a door arrangement for opening and closing the front opening of the hangar building and which comprises:

two upper door panels in coplanar side by side relationship, one door panel on one side and one door panel on the other side of the opening apex, said two upper door panels each having side edges which are vertical when the door arrangement is closed and upper and lower edges inclined parallel to the upper boundary of the door opening on the side of the apex beneath which the door panel is positioned;

means pivotally suspending the upper door panels from the hangar building respectively for rotation about their inclined upper edges;

two lower door panels in coplanar side by side relationship, one lower door panel beneath each upper door panel, the lower door panels each having vertical side edges, an upper edge inclined parallel to the lower edge of the upper door panel beneath which the lower door panel is positioned, and a horizontal bottom edge;

means pivotally suspending the lower door panels at their upper edges from the lower edges of the respective upper door panels; and an operating mechanism for opening the door arrangement; wherein said operating mechanism comprises a driving means, and means coupling the driving means to the door panels for raising the lower door panels in vertical coplanar relationship as the upper door panels rotate on their respective pivotal suspension means, whereby in a fully open position the lower door panels provide space beneath them for passage of the aircraft wings and space between them for passage of the aircraft tailgate.

The arrangement is preferably symmetrical about the vertical centre line of the door opening, more especially to suit a hangar building having a centre pitched roof.

Each of the door panels is preferably an approximately planar structure, but deviates therefrom to form a shallow pyramid. When the door is mounted to the hangar building, the apex of each door panel pyramid is preferably displaced, relative to the plane defined by the four corners of the door panel, towards the inside of the building.

The panels may conveniently be hollow moulded of GRP (glass fibre reinforced plastics material), with high density plastics foam injected to the inside. Such a panel construction provides stiffness against twisting coupled with high thermal insulation.

The operating mechanism for the door comprises struts articulated between two mountings on the hangar building and followers which run on guides extending across the lower door panels at or adjacent the upper edges of the latter, together with means for driving the followers along the guides. A drive applied to the follower or followers on the guide of a lower door panel causes the lower panel to lift generally in a vertical plane, accompanied by rotation of the associated upper panel out of the vertical plane, towards a horizontal plane in which the upper panel is disposed in the fully open position of the door. The two lower panels may be simultaneously driven.

Preferably, articulated struts also connected between the said mountings and the lower door panels serve to prop the lower door panels against the wind, both when the door is closed and when it is open.

In a preferred arrangement, the followers on the lower door panel guides are cable driven from motors also accommodated in the said respective mountings on the hangar building, the first mentioned articulated struts being tubular and winch wires passing therethrough from the motor to the follower on the guide of the corresponding lower door panel, said guide taking the form of a rail along which the follower can slide. However, it is alternatively possible to employ threaded guide rails and followers in the form of nuts running along said threaded rails.

BRIEF DESCRIPTION OF DRAWINGS

The hangar door arrangement in accordance with the invention is exemplified in the following description, making reference to the accompanying drawings, in which.

DESCRIPTION OF EMBODIMENT

The illustrated hangar door comprises two upper panels 10A, 10B and two lower panels 12A, 12B for closing an aircraft hangar front in the case of a building having a centre pitched roof.

The upper door panels 10A, 10B are generally of rhombic shape, with inclined upper edges 14 pivotally connected to the slopes of the pitched roof, so that the pivot axes intersect at the top centre of the door. The lower edges 16 are similarly inclined, and in the closed condition also meet on the vertical centre line of the hangar door.

The lower door panels 12A, 12B are generally of trapezoidal shape, with inclined upper edges 18 meeting the lower edges of the upper panels, from which the lower panels are pviotally suspended on pivot axes disposed along the meeting edges 16, 18. The bottom edges 20 of the lower panels are horizontal and collinear, and also meet at the vertical centre line of the door in the closed condition.

Figure 1:
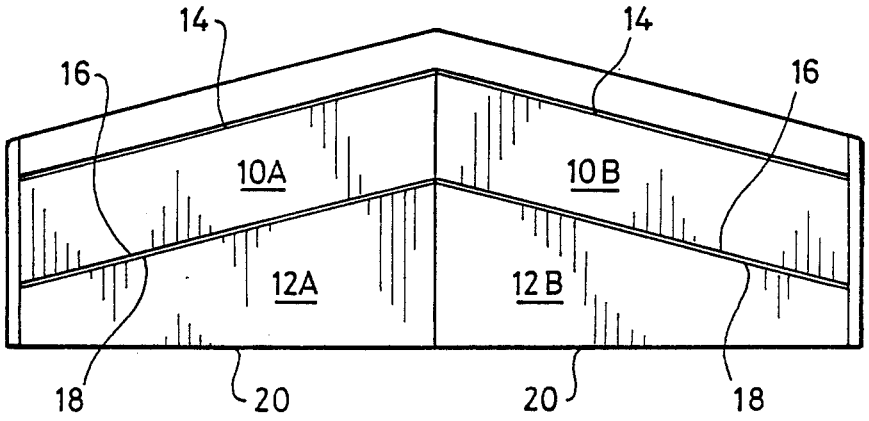
FIG. 1 shows the hangar door from the front, in the closed condition.
Figure 2:
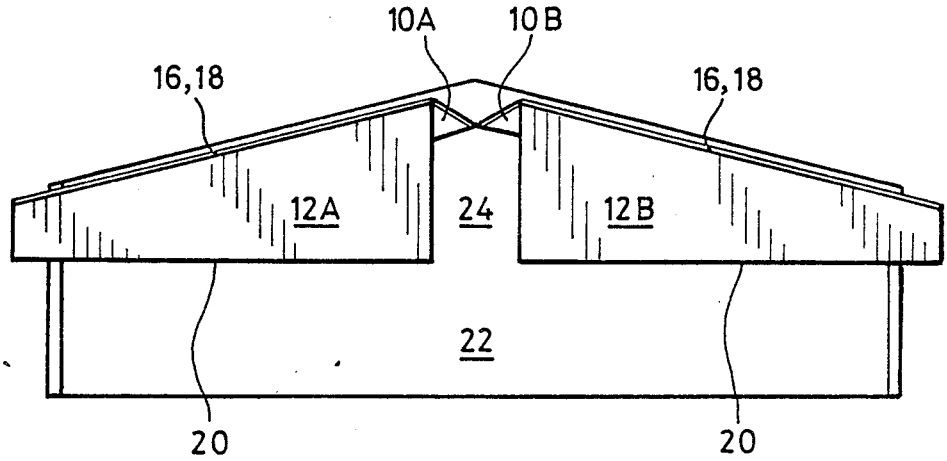
FIG. 2 shows the hangar door from the front, in the open condition.
Figure 3:
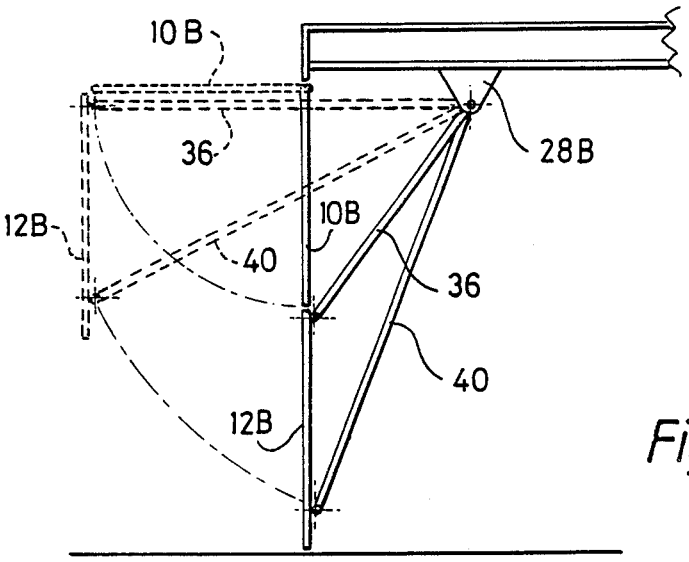
FIG. 3 shows the hangar door from the side, in the open condition.

In the open condition of the door shown in FIGS. 2 and 3, the upper panels 10A, 10B are rotated into a generally horizontal plane and project outwardly from the hangar building. The lower panels 12A, 12B are raised in vertical orientation into a vertical plane displaced outwardly relatively to the closed door plane. Due to the inclinations of the pivot axes 14 and 16, 18, in the open condition a space 22 is created beneath the hangar door for passage of an aircraft body fuselage and wings, whilst the lower panels are moved apart to create a space 24 between them for passage of the aircraft tailgate.

Each door panel is a hollow moulded shell of GRP (glass fibre reinforced plastics material), having injected high density urethane foam injected to the inside. The panel moulding forms a shallow pyramid 26 (FIG. 4) to the inside surface of each panel.

Figure 4:
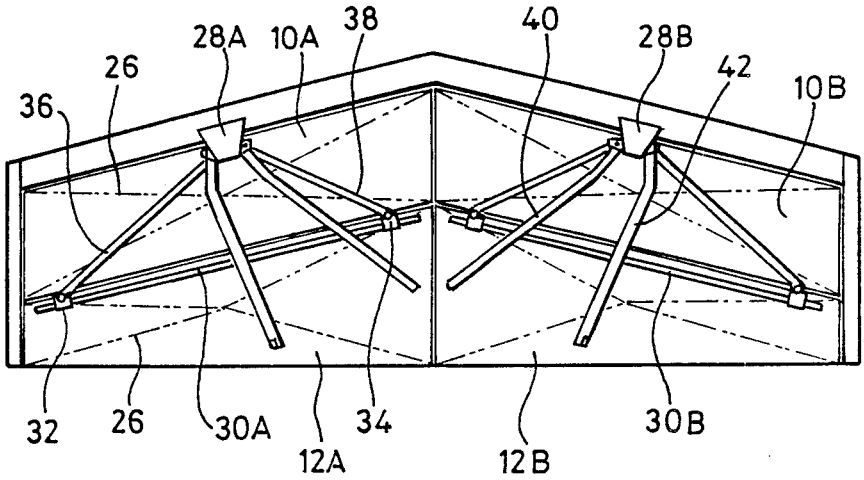
FIG. 4 shows the operating mechanism on the inside of the door.

The operating mechanism for the door is shown in FIG. 4. Motor pod mountings 28A, 28B are provided adjacent the roof of the hangar building, one for each side of the door, which can be seen to be symmetrical about its vertical centre line. A guide rail 30A, 30B is mounted to each lower door panel 12A, 12B adjacent the pivot line 16, 18 at which the lower panel is suspended from the upper panel, and each guide rail carries a pair of followers 32, 34 slidable along said rail. Tubular fixed length struts 36, 38 are articulated between the respective mounting 28A or 28B and the followers 32, 34 on the guide rail 30A or 30B of the corresponding lower door panel 12A or 12B, and winch cables (not visible in FIG. 4 but shown in FIGS. 5 and 6) pass from the driving motors through the tubular struts 36 to said followers. Also as illustrated, articulated fixed length struts 40, 42 are hingedly connected between respective motor pods and lower door panels, and keep the lower panels substantially vertical during their outward and upward movement. Thus, by means of the described driving means, each lower door panel 12A, 12B can be raised as aforesaid, accompanied by rotation of the corresponding upper panel 10A, 10B.

Figure 5:
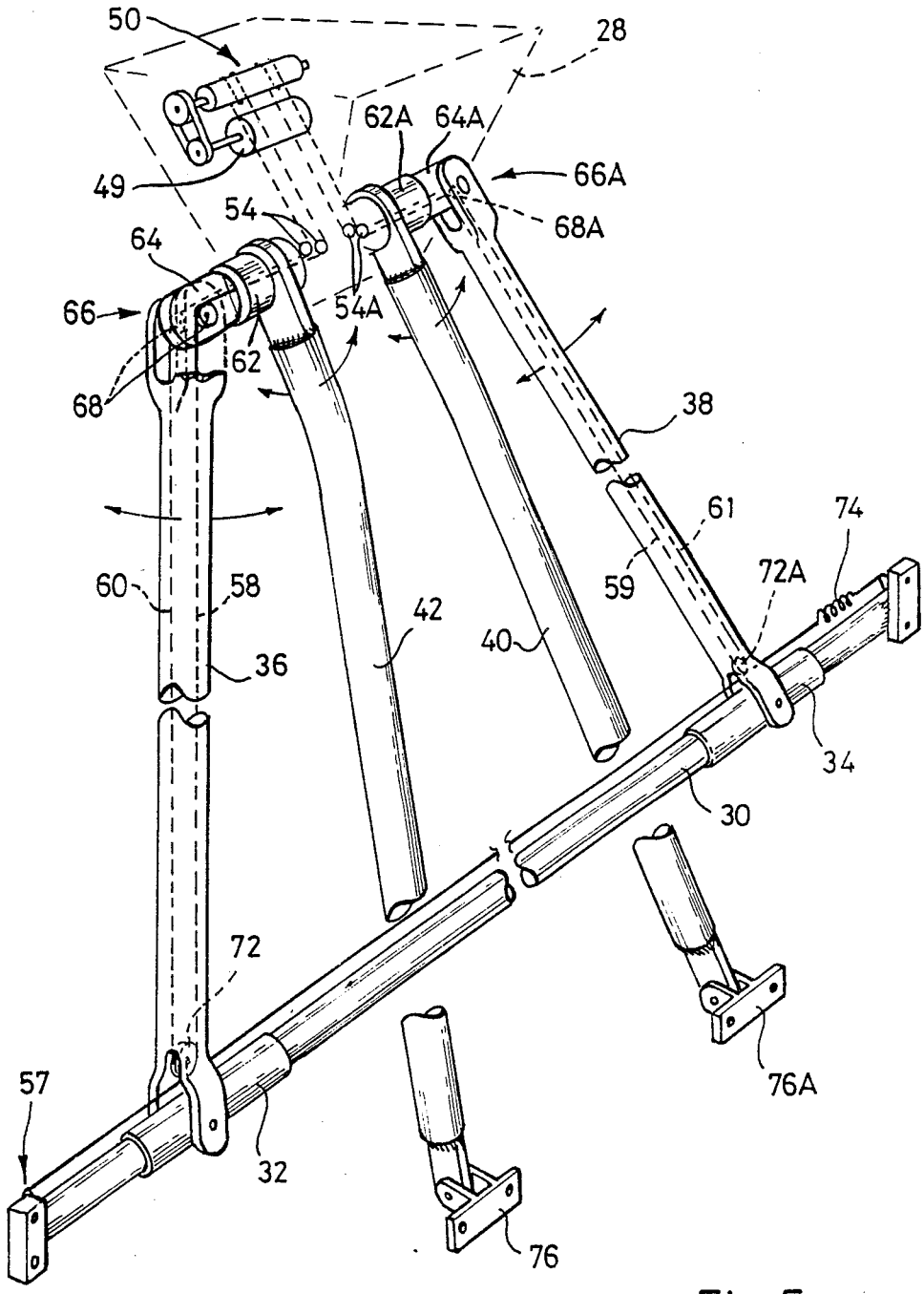
FIG. 5 shows detail of the operating mechanism.
Figure 6:
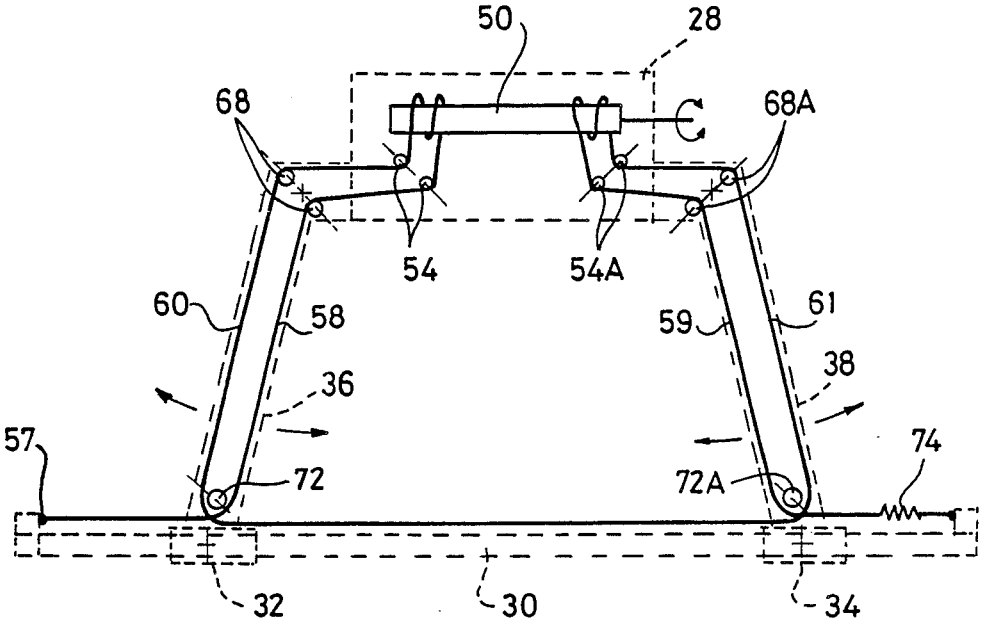
FIG. 6 shows the path of an operating cable forming part of the operating mechanism.

For further detail of the operating mechanism, reference is now made to FIGS. 5 and 6. This detail shows one of the motor pod mountings 28A and 28B, which in FIGS. 5 and 6 is referenced 28, together with the associated struts and winch cable necessary to open and close one side of the door. The motor pod and the strut and cable arrangement for the other side of the door is identical and, in use, the two mechanisms are operated in synchronism. The guide rail adjacent the upper edge of the lower door panel is referenced 30 in FIGS. 5 and 6. The mounting 28 is fixed to the hangar building and, in addition to housing a driving motor 49, accommodates a motor driven capstan 50 with two spools. The motor pod mounting also carries a pair of supports 62, 62A in which respective external brackets 64, 64A are rotatable. The struts 36, 38 are pivotally mounted at 66, 66A to the respective brackets 64, 64A to permit these struts to turn as the followers 32, 34 move along the guide rail 30, the rotational mounting of the brackets permitting the struts 36, 38 also to turn outwardly as the lower panels are lifted upwardly and outwardly.

The motor pod mounting also accommodates respective pairs of pulleys 54, 54A respectively associated with the struts 36, 38, whilst the brackets 64, 64A also carry pairs of pulleys 68, 68A associated with the respective struts.

At the remote end of the strut 36, and likewise the strut 38, said strut 36 or 38 is connected to the follower 32 or 34, each of which takes the form of a metal tube which can slide on the guide rail 30 mounted adjacent the upper edge of the lower door panel. This remote end of each strut 36 or 38 also carries a single pulley 72 or 72A.

A long length of winch cable, the path of which is shown in FIG. 6, has one end 57 fixed to one end of the guide rail 30, and thence extends parallel to the guide rail to pass around the single pulley 72 at the bottom of the hollow tubular strut 36, thence up the inside of the strut to one of the pair of pulleys 68 at the mounting bracket 64 of the strut. From this pulley 68 the cable passes to and around one of the pair of pulleys 54 inside the motor pod housing 28, and from there up to and around one spool of the motor driven capstan 50. Having passed around the capstan spool with several turns, the cable then extends back down to the second pulley of the pair of pulleys 54, thence to the second pulley of the pair 68, back down the inside of the strut around the same single pulley 72 at the bottom of the strut 36, and thence extends parallel to the guide rod 30 to the corresponding single pulley 72A at the bottom of the strut 38. At this strut 38 the winch cable extends in identical manner to the arrangement at the strut 36, passing up through the inside of the strut 38 to the first pulley of the other pair of pulleys 68A and around the first pulley of the other pulley pair 54A to the other spool of the motor capstan. After several turns around this other spool, the cable passes around the second pulleys of the other pulley pairs 54A, 68A, back down the strut 38 and around the pulley 72A at the bottom of this strut, and from there to the other end of the guide rail 30, to which the other end of the winch cable is fixed by means of a tensioning spring 74.

In FIGS. 5 and 6, the length of winch cable extending from the first end of the guide rail 30 up to the first spool of the capstan 50 is referenced 58, whilst that length returning from this spool of the capstan to the pulley 72 at the bottom of the strut 36 is referenced 60. The length of winch cable extending up to the other spool of the capstan from the pulley 72A at the bottom of the strut 38 is referenced 59, whilst the cable length extending back between this other spool and the other end of the guide rail 30, where the cable is tensioned, is referenced 61.

As already stated, an identical driving arrangement is provided for the lower door panel on each side of the door, the two driving motors being synchronously operated.

The struts 40 and 42 are hinged at the top to turn about the respective supports 62, 62A, and hinged at the bottom by brackets 76, 76A to the lower door panels, whereby these struts are able to turn outwardly as the lower door panel moves upwardly and outwardly when the door is opened.

Thus, assuming, as indicated in FIG. 5, that the followers 32, 34 at the remote ends of the two struts 36,38 are positioned adjacent the outer ends of the guide rail 30 when the door arrangement is fully closed, then when the motor is operated to turn the capstan 50 in the appropriate direction, pulleys 78 tend to wind along the cable away from the adjacent fixed ends of the cable, i.e. towards the centre of the guide rail 30, followers 32 and 34 respond by movement along the guide rail 30, whereby the remote ends of the struts 36, 38 are moved towards one another, and thereby also caused to move outwardly and upwardly, in a curved path, in unison with one another. The drive applied to the pulleys 72, 72A is attributable to the fact that, when the capstan 50 is turned, one pulley length 58 (or 59) must shorten and one pulley length 59 (or 61) must lengthen. Thus, the motor drive causes the two remote ends of the fixed length struts 36, 38 to be moved equally and oppositely towards one another along the guide rail. This causes said struts 36, 38 also to rotate with the respective rotatably mounted support brackets 64, 64A, thus producing a lifting of the lower door panels, and an accompanying forward movement away from the front of the hangar. The struts 40 and 42 are also caused to turn outwardly and upwardly, maintaining the lower panels in coplanar vertical relationship as they lift. The lifting drive applied to the lower door panels in turn causes the upper door panels to lift, in an up and over manner, on their pivotal mountings to the pitched roof. As the pivotal connection between the lower edge of the upper panels and the upper edge of the lower panels is also inclined parallel to the pitch of the roof, the lower panels also move apart, in laterally opposite directions, until the fully open condition is reached in which the upper door panels are substantially horizontal and the lower panels depend vertically therefrom with spacing between them.

When wind blows on to the panels, load is passed into the struts. However, the followers 32, 34 cannot move provided the capstan is unable to turn. A helical gear incorporated in the drive between the motor and the capstan is useful to ensure that the capstan cannot turn except under drive from the motor. The struts 40 and 42 ensure that the lower door panels are propped against flapping on their pivotal connections to the upper door panels.

It will be appreciated that the above described and illustrated arrangement of the hangar door may be modfiied in various ways within the scope of the invention as defined in the appended claims.

I claim:

1. In combination with an aircraft hangar building for housing an aircraft which includes wings and a central tailgate, said hangar building having a front opening which has an upper boundary of inverted V-shape defining an apex of the opening, a door arrangement for opening and closing the front opening of the hangar building and which comprises:

two upper door panels in coplanar side by side relationship, one door panel on one side and one door panel on the other side of the opening apex, said two upper door panels each having side edges which are vertical when the door arrangement is closed and upper and lower edges inclined parallel to the upper boundary of the door opening on the side of the apex beneath which the door panel is positioned, pivotal suspension means pivotally suspending the upper door panels from the hangar building respectively for rotation about their inclined upper edges;

two lower door panels in coplanar side by side relationship, one lower door panel beneath each upper door panel, the lower door panels each having vertical side edges, an upper edge inclined parallel to the lower edge of the upper door panel beneath which the lower door panel is positioned, and a horizontal bottom edge;

hinge means pivotally suspending the lower door panels at their upper edges from the lower edges of the respective upper door panels;

each upper and lower pivotally suspended door panel includes an operating mechanism, said operating mechanism comprises a mounting disposed on said hangar building, a guide means disposed on said lower door panel, two struts each of which includes on a first end thereof a follower means for slidably engaging said guide means, said struts being articulated on a second end thereof to said mounting means, and means for driving said follower means along the guide means;

wherein said operating mechanism raises the lower door panels in vertical coplanar relationship as the upper door panels rotate on their respective pivotal suspension means, whereby in a fully open position the lower door panels provide space beneath them for passage of the aircraft wings and space between them for passage of the aircraft tailgate.

2. The combination according to claim 1, wherein the door opening and door arrangement are symmetrical about a vertical centre line through the apex of the door opening.

3. The combination according to claim 2, wherein the hangar building has a centre pitched roof extending from front to back.

4. The combination according to claim 1, wherein each of the door panels has the shape of an approximately planar structure, but deviates therefrom to form a shallow pyramid on its inside surface.

5. The combination according to claim 4, wherein the shallow pyramid formed by the inside surface of each door panel has an apex which is displaced, relative to the plane of the approximately planar structure of the panel, towards the inside of the hangar building.

6. The combination according to claim 1, wherein the panels are molded as a shell of glass fiber reinforced plastic material with high density plastics foam injected within the shell.

7. The combination according to claim 1, wherein said struts are tubular struts, and said means for driving said follower means along the guide means include motors accommodated in said respective mounting means on the hangar building, and winch wires passing through the tubular struts from the motor to the follower means on the guide means of the corresponding lower door panel.

8. The combination according to claim 7 having articulated undriven struts disposed between said mounting means and the lower door panels.

* * * * *